US010244807B2

(12) United States Patent
Kantor et al.

(10) Patent No.: US 10,244,807 B2
(45) Date of Patent: Apr. 2, 2019

(54) AIRWAY OPENING DEVICE FOR HELMETS AND A HELMET COMPRISING THE SAME

(71) Applicant: INOVYTEC MEDICAL SOLUTIONS LTD, Hod Hasharon (IL)

(72) Inventors: Ehud Kantor, Hod Hasharon (IL); Nir Barkai, Kfar Sava (IL)

(73) Assignee: INOVYTEC MEDICAL SOLUTIONS LTD., Hod Hasharon (IL)

( * ) Notice: Subject to any disclaimer, the term of this patent is extended or adjusted under 35 U.S.C. 154(b) by 58 days.

(21) Appl. No.: 15/529,359

(22) PCT Filed: Dec. 9, 2015

(86) PCT No.: PCT/IL2015/051191
§ 371 (c)(1),
(2) Date: May 24, 2017

(87) PCT Pub. No.: WO2016/092545
PCT Pub. Date: Jun. 16, 2016

(65) Prior Publication Data

US 2018/0317587 A1 Nov. 8, 2018

(30) Foreign Application Priority Data

Dec. 11, 2014 (IL) ..... 236216

(51) Int. Cl.
*A42B 3/00* (2006.01)
*A42B 3/04* (2006.01)
*A42B 3/32* (2006.01)

(52) U.S. Cl.
CPC ..... *A42B 3/046* (2013.01); *A42B 3/00* (2013.01); *A42B 3/0406* (2013.01); *A42B 3/0473* (2013.01); *A42B 3/328* (2013.01)

(58) Field of Classification Search
CPC ..... A42B 3/00; A42B 3/0473; A42B 3/068; A42B 3/085; A42B 3/105
See application file for complete search history.

(56) References Cited

U.S. PATENT DOCUMENTS 6,918,394 B2 7/2005 Matsuda et al.
8,256,033 B2 * 9/2012 Arai ..... A42B 3/127 2/414

(Continued)

FOREIGN PATENT DOCUMENTS

GB 2481522 A 12/2011
JP 2000116662 A 4/2000

(Continued)

OTHER PUBLICATIONS

International Search Report for PCT/IL2015/051191, 3 pages, dated Mar. 16, 2016.

(Continued)

*Primary Examiner* — Tajash D Patel
(74) *Attorney, Agent, or Firm* — Roach Brown McCarthy & Gruber, P.C.; Kevin D. McCarthy

(57) ABSTRACT

A helmet mounted safety device comprises right and left mandible engaging sections. Each of the mandible engaging sections comprises an adjustable airway opening member for assuring opening of the airway, and is connected, whether integrally or detachably, to a side portion within an interior of a helmet in order to facilitate engagement with the mandible of a wearer of the helmet upon demand. A helmet comprising the right and left mandible engaging sections is also taught, and further comprises in one embodiment a neck stabilizing cervical support that includes an occipital portion and two sternocleidomastoid (SCM) portions between which the occipital portion is interposed, for engaging the SCM muscle at the side of the neck.

17 Claims, 7 Drawing Sheets

(56) References Cited

U.S. PATENT DOCUMENTS

| | | | | |
|---|---|---|---|---|
| 8,549,671 | B2 * | 10/2013 | Sackett | A42B 3/328 2/414 |
| 8,887,318 | B2 | 11/2014 | Mazzarolo et al. | |
| 9,060,557 | B2 * | 6/2015 | Maier | A42B 3/326 |
| 9,332,798 | B2 | 5/2016 | Gafforio et al. | |
| 9,681,697 | B2 * | 6/2017 | Ikeda | A42B 3/127 |
| 9,788,593 | B2 * | 10/2017 | Lebel | A42B 3/326 |
| 2007/0118060 | A1 | 5/2007 | Gefen | |
| 2007/0124852 | A1 | 6/2007 | Pyo | |
| 2012/0186591 | A1 | 7/2012 | Sethi | |
| 2015/0135417 | A1 * | 5/2015 | Lebel | A42B 3/326 2/424 |

FOREIGN PATENT DOCUMENTS

| | | | |
|---|---|---|---|
| WO | 2005/051251 | A2 | 6/2005 |
| WO | 2011/133788 | A2 | 10/2011 |

OTHER PUBLICATIONS

Written Opinion of the International Searching Authority for PCT/IL2015/051191, 4 pages, dated Mar. 16, 2016.

Omri Lubovsky et al., "A new external upper airway opening device combined with a cervical collar Resuscitation". Official journal of the European resuscitation council, Jul. 2010, vol. 81, pp. 817-821. XP055480646 ( 8 pages).

Supplementary European Search Report for EP 15 86 6507, dated Jun. 15, 2018, 6 pages.

* cited by examiner

AIRWAY OPENING DEVICE FOR HELMETS AND A HELMET COMPRISING THE SAME

FIELD OF THE INVENTION

The present invention generally relates to a non-invasive airway opening device for helmets. More particularly, the invention relates to a jaw thrust maneuver performing device which is attachable to a helmet, for facilitating opening of the airway and monitoring of the anterior triangle of the neck following a traumatic event to which the wearer of the helmet, such as a motorcycle rider, was subjected.

BACKGROUND OF THE INVENTION

In the practice of emergency medicine and the treatment of trauma it is common for a patient to lose consciousness and the ability to maintain open airways and respiration. Loss of respiration is often fatal. There are several methods known in the art for maintaining open airways. All invasive methods to maintain an open airway involve devices that are inserted into the airway and mechanically supply an open tube aimed to maintain an open airway. One invasive technique is surgical cricothyroidotomy involving the insertion of a tube through the neck of the patient. Other invasive techniques involve tracheal intubation or laryngeal mask. The non-invasive way to protect the airway in trauma patients is by manually pushing the jaw forward. This becomes much more complicated in a case when a helmet removal is required, e.g., in a road traffic accident that involves a motorcyclist or any other incidents involving a patient with a helmet on.

In the practice of emergency medicine it is known that unsafe to attempt to remove the helmet of a motorcyclist who has been injured in a road traffic accident. Doing so could exacerbate any spinal injury the rider may have suffered, which could lead to serious paralysis or even death. But there are times when removing the helmet is unavoidable if the injured rider's life is to be saved, such as when the rider has stopped breathing and an emergency resuscitation must be perform.

There is therefore a need to open an airway without removing the helmet and to maintain open airways, as suffocation condition, is highly damaging, often fatal, and usually irreversible. Therefore there is a need for a novel helmet device to enable opening of the airways.

There are techniques known in the art for maintaining open airways by maintaining an open mouth, but none of them refer to a wearer of a helmet, such as a motorcyclist.

It is an object of the present invention to provide a non-invasive airway opening device for a helmet that facilitates both opening of the airway as well as monitoring of the throat following a traumatic event without removing the helmet off the wearer's head.

Other objects and advantages of the invention will become apparent as the description proceeds.

SUMMARY OF THE INVENTION

The present invention provides a helmet mounted safety device for ensuring an open airway, comprising right and left mandible engaging sections, wherein each of said mandible engaging sections comprises an adjustable airway opening member for assuring opening of the airway, wherein each of said mandible engaging sections is connected to a side portion within an interior of a helmet in order to facilitate engagement with the mandible of a wearer of said helmet upon demand.

In one aspect, the airway opening device is fixed to fit the neck and face sizes of most people. In another aspect the airway opening device is adjustable to fit the neck and face sizes of a specific wearer.

In one aspect, the airway opening device further comprises a cervical support that is adapted to be in neck stabilizing engagement with the neck the helmet wearer, wherein the cervical support includes an occipital portion and two sternocleidomastoid (SCM) portions between which said occipital portion is interposed for engaging the SCM muscle at the side of the neck. The cervical support is preferably of bilateral symmetry. In one aspect, the occipital portion and the two SCM portions are formed as a single unit.

In one aspect, each of the mandible engaging sections comprises a baseplate and a carrier for the airway opening member which is controllably displaceable along a groove formed in said baseplate. The carrier may be longitudinally and ratchetedly displaceable along the groove, being connected to a manipulator by a fastening element passing through the groove. The airway opening member protrudes medially from the baseplate and the manipulator protrudes distally therefrom.

The airway opening member is an external device that applies a force onto the corresponding mandible angle to push the mandible forwardly and to cause the jaws to open, thereby preventing backward collapse of the mandible and suffocation.

The airway opening member comprises a first element for contacting the bottom of the mandible angle and a second element which is angularly spaced and extends upwardly from said first element, for example by an angle ranging from 110 to 160 degrees.

The airway opening member supports the mandible in two directions. As it supports the mandible from below, and also applies a force onto the mandible angle from behind, it induces forward movement of the mandible to enable opening of the airway while continuing to prevent flexion movement of neck. Since the vector that prevents flexion is applied to the mandible by the airway opening member from both sides, the front portion of the helmet may be removable for allowing access to the neck.

In one aspect, the displacement of the mandible engaging sections forward can be done automatically, by using a spring force based device, an electromechanical device or any other device suitable of pushing forward the carrier of the airway opening member.

In one aspect, the airway opening member is activated automatically after detecting an accident event by an integrated impact sensor or by remote operation from a control center.

In one aspect, each of the mandible engaging sections is integrally formed with the interior of the helmet.

In one aspect, the safety device further comprises one or more detachment elements for facilitating detachment of the device from the interior of the helmet and removal of the helmet without necessitating movement of the airway opening member.

The present invention is also directed to a helmet with an airway opening device for ensuring an open airway for the wearer of the helmet, comprising right and left mandible engaging sections, wherein each of said mandible engaging sections comprises an adjustable airway opening member for assuring opening of the airway, wherein each of said mandible engaging sections is connected to a side portion of an interior of said helmet in order to facilitate engagement with the mandible of the wearer upon demand.

According to an embodiment of the invention, the helmet is provided with a removable front portion for allowing access to the neck.

DETAILED DESCRIPTION OF PREFERRED EMBODIMENTS

The present invention relates to an airway opening device for helmets that facilitates opening of the airway, for example by the jaw thrust maneuver, and enables a medical practitioner to monitor clinical conditions of the anterior triangle of the neck. The airway opening device of the present invention is engaged onto the subject (i.e., the wearer of the helmet) by a practitioner standing at the subject's front who simultaneously manipulates right and left engagement elements to ensure opening of an airway.

Figure 1:
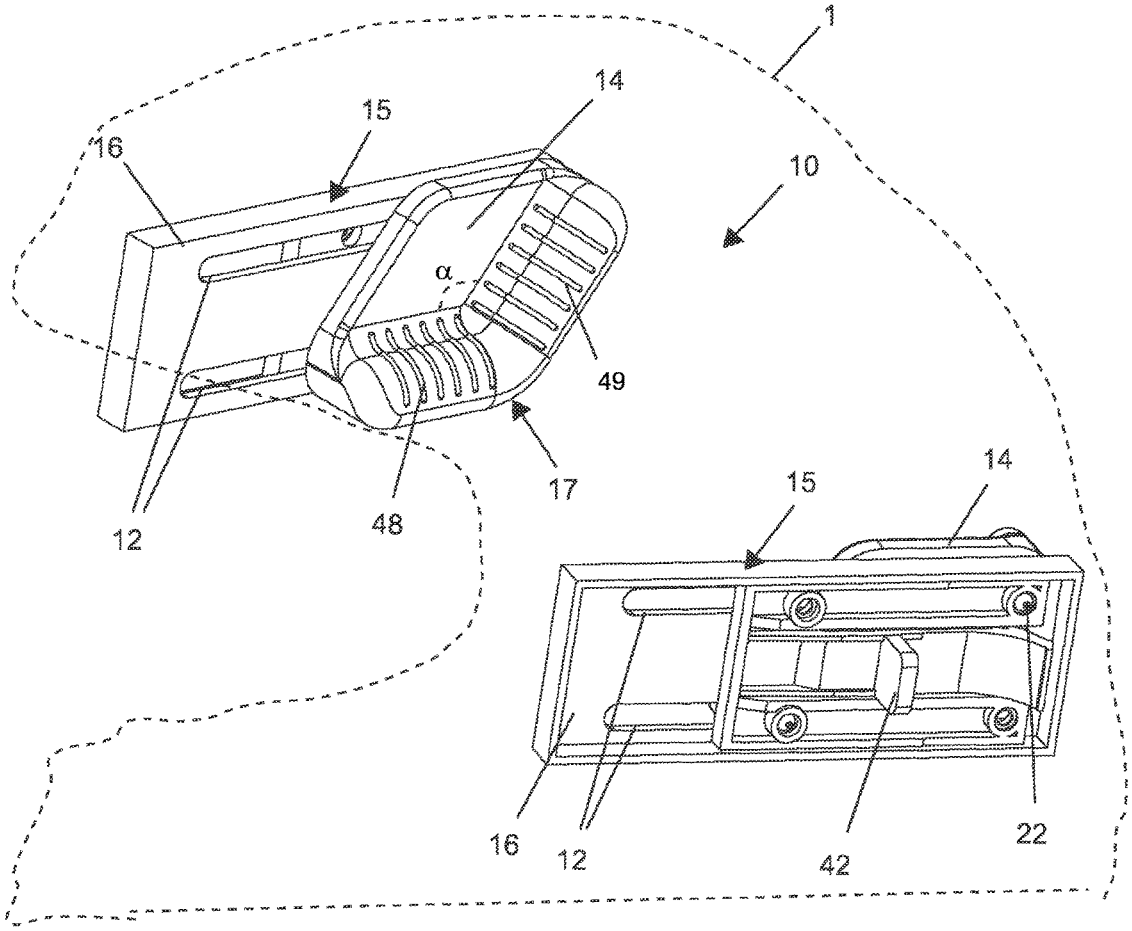
FIG. 1 is a perspective view of an airway opening device for helmets, according to one embodiment of the present invention.
Figure 2:
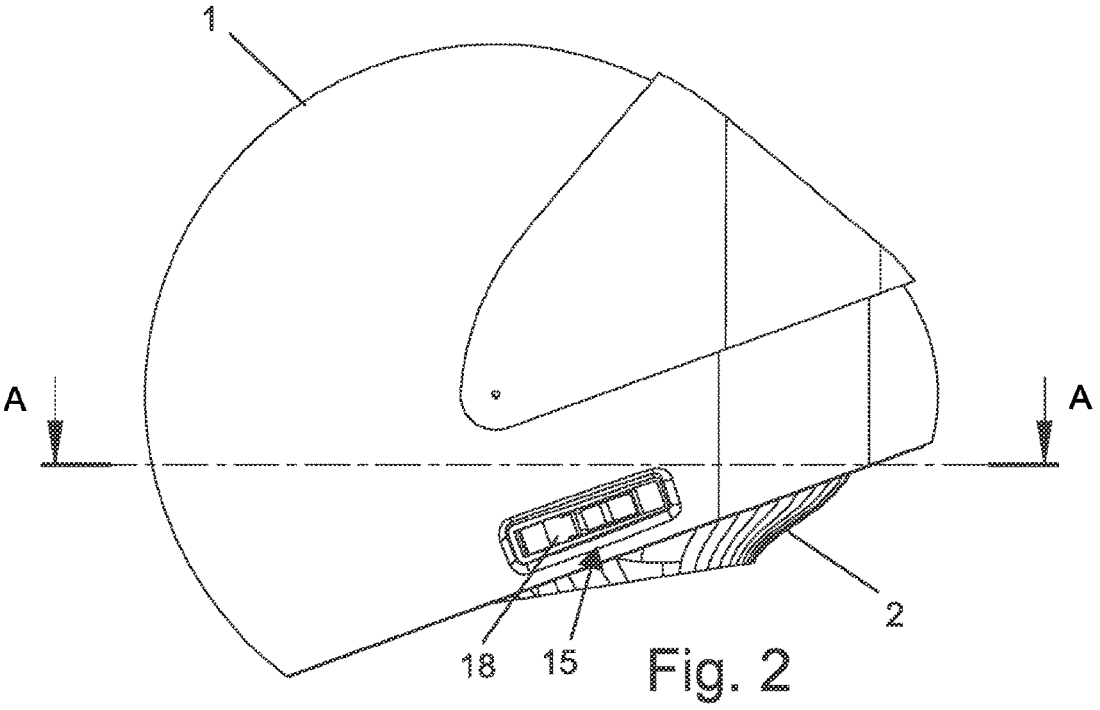
FIG. 2 is a side view of a helmet used in conjunction with the cervical support device of FIG. 1, according to an embodiment of the invention.

FIG. 1 shows an airway opening device that can be used in conjunction with the invention. The device illustrated in this figure is particularly convenient because it can be applied as an add-on device to existing helmets without the need to carry out major alterations in the helmet's structure. The device generally indicated by numeral 10 in the figure comprises left and right mandible engaging sections 15. Mandible engaging section 15 comprises a baseplate 16, carrier 14 which is longitudinally and adjustably displaceable along the length of baseplate 16 from a distal side to a proximate or medial side, and angled airway opening member 17 protruding from carrier 14. Carrier 14 is displaceable by a manipulator 42 located at the back side of baseplate 16. Baseplate 16 is adapted to be integrated or mounted about the inner side of a helmet 1 (FIGS. 2-5) such that angled airway opening member 17 is facing the inner space of helmet 1 and manipulator 42 is accessible to be manually operated via the outer side of helmet 1 as shown in FIG. 2. FIG. 1 illustrates a perspective view of mandible engaging sections 15 when helmet 1 is removed, for purposes of clarity.

Activating the airway opening device is done by pushing the mandible engaging section forward either manually or automatically. This can be obtained by applying a variety of devices suitable of automatically or manually pushing forward the carrier for the airway opening member (towards the front section of the helmet). For example, the displacement of the mandible engaging sections forward can be done by applying a spring force based device, an electromechanical device and the like. According to some embodiments of the invention, the airway opening device is activated automatically after detecting an accident event by an integrated impact sensor or by remote operation from a control center.

Although baseplate 16 is described as having a "medial" or "proximate" side, and a "distal" side for describing a relative location when mandible engaging section 15 is bodily engaged and carrier 14 is able to slide from one side to another, it is to be noted that these or other directional terms are also relevant to describe relative locations when mandible engaging section 15 is not bodily engaged. Accordingly, when carrier 14 is in the distal side of baseplate 16 (closer to the rear side of helmet 1), cervical support device 10 is not in use (i.e., "non-support" mode), and when carrier 14 is slid to the proximate side of baseplate 16 (closer to the front side of helmet 1) then cervical support device 10 is used to support the wearer's mandible (i.e., "support" mode).

Baseplate 16 is formed with at least one longitudinal groove 12, e.g. oval, along which carrier 14 is displaceable. One, or any other number of, fastening elements 22, which connect carrier 14 to manipulator 42 protruding from the distal side of baseplate 16, e.g. a curved handle, pass through groove 12 to enable the longitudinal displacement of carrier 14 to permit controllable and adjustable displacement of carrier 14.

Airway opening member 17 medially protruding from carrier 14 has a first substantially horizontal element 48 that is substantially parallel to bottom edge of baseplate 16 and a second element 49 angled upwardly from first element 48. Angle "$\alpha$" between first element 48 and second element 49 ranges from 110-160 degrees. This angle is sufficient to cause, when airway opening member 17 is engaged with the angle of the mandible in the vicinity of the ramus, at a corresponding distal end of the mandible, the jaws to open for ensuring an open airway. First element 48, when supporting the bottom of the mandible angle, also serves to prevent downward tilt or flexion of the neck.

Figure 3:
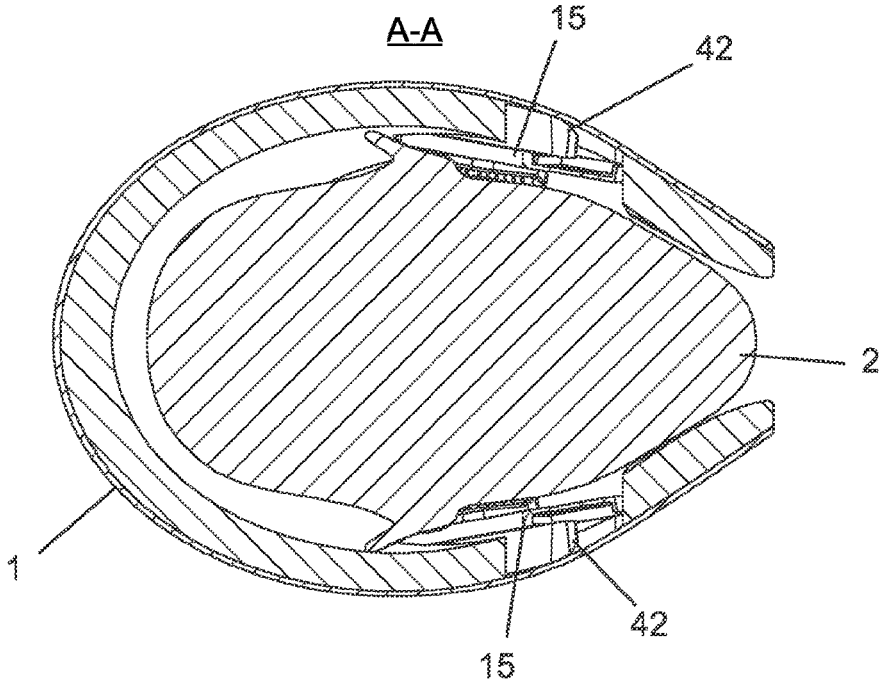
FIG. 3 is a cross-sectional view of the helmet of FIG. 2.
Figure 4B:
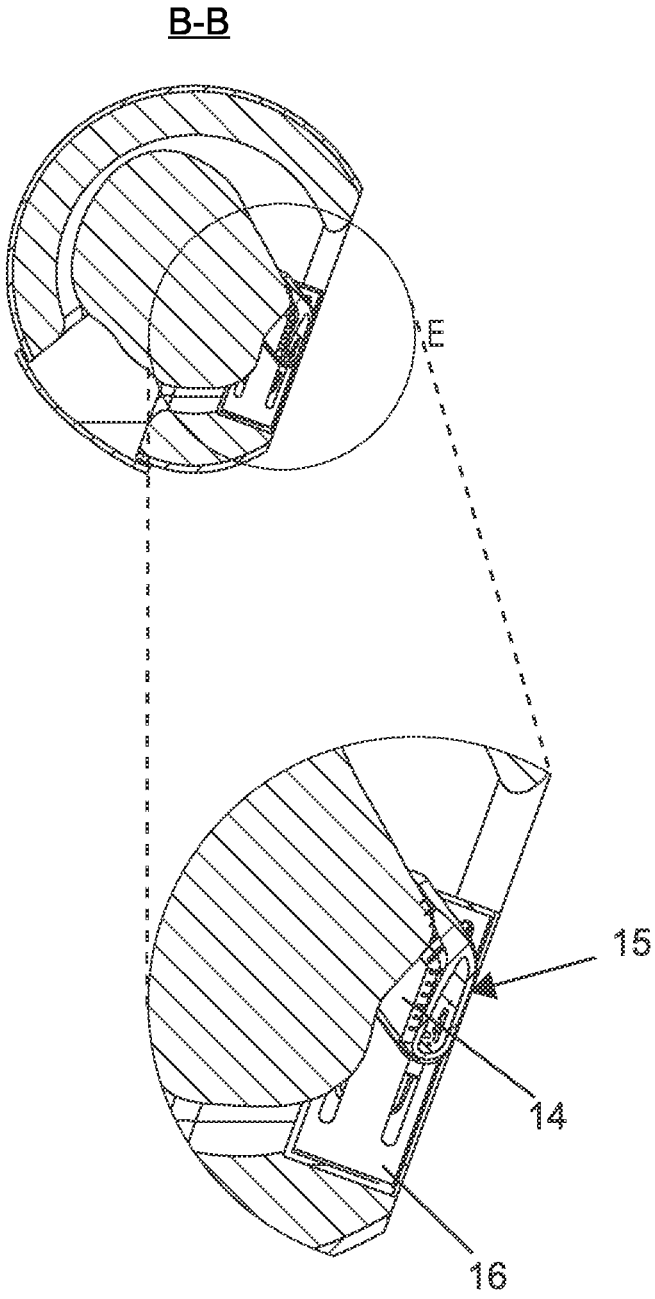
FIG. 4B is a cross-sectional detailed view of FIG. 4A showing the mandible engaging section of the cervical support device.
Figure 4A:
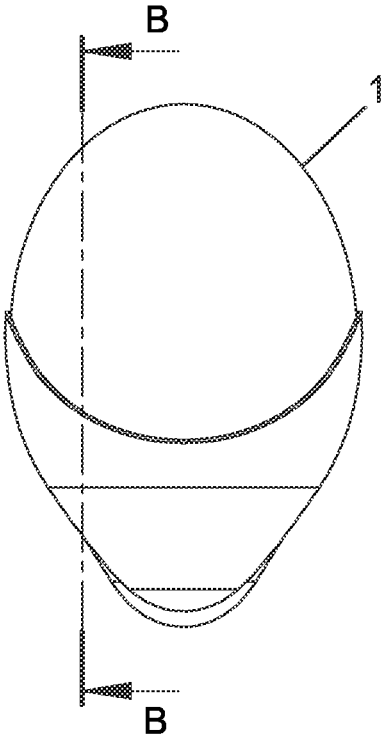
FIG. 4A is a top view of the helmet of FIG. 2.

FIG. 2 illustrates a side view of an assembled an airway opening device 10 within helmet 1. As shown, the actuating slider 18 of mandible engaging section 15 is accessible via the side surface of helmet 1. FIG. 3 illustrates a cross-sectional view of cervical support device 10 along the section line A-A in FIG. 2, showing baseplates 16. FIG. 4A illustrates a top view of FIG. 2, wherein FIG. 4B illustrates a detailed cross sectional view of the mandible engaging section 15 within helmet 1 along the section line B-B in FIG. 4A.

Figure 5:
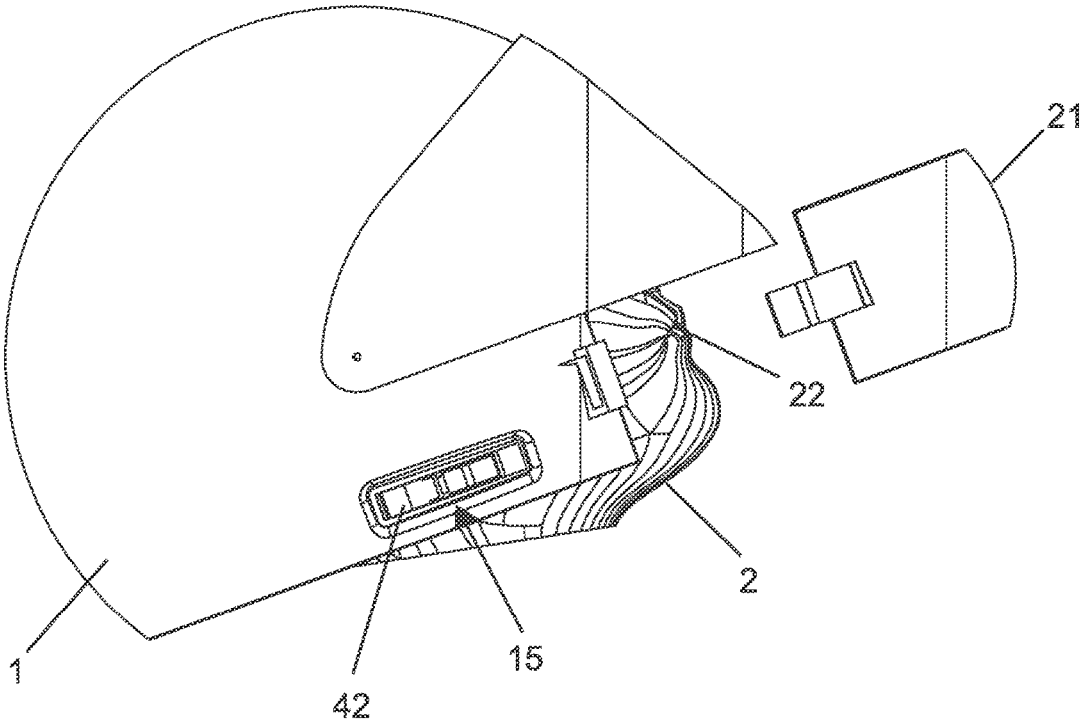
FIG. 5 is a side view of a helmet used in conjunction with the cervical support device of FIG. 1 that is provided with a detachable front section, according to an embodiment of the invention.

FIG. 5 illustrates a side view of helmet 1 that is provided with a detachable front section 21, according to an embodiment of the invention. As can be easily seen in the figure, the detachable front section provides a better access to the mouth 22 of the helmet's wearer 2.

Figure 6:
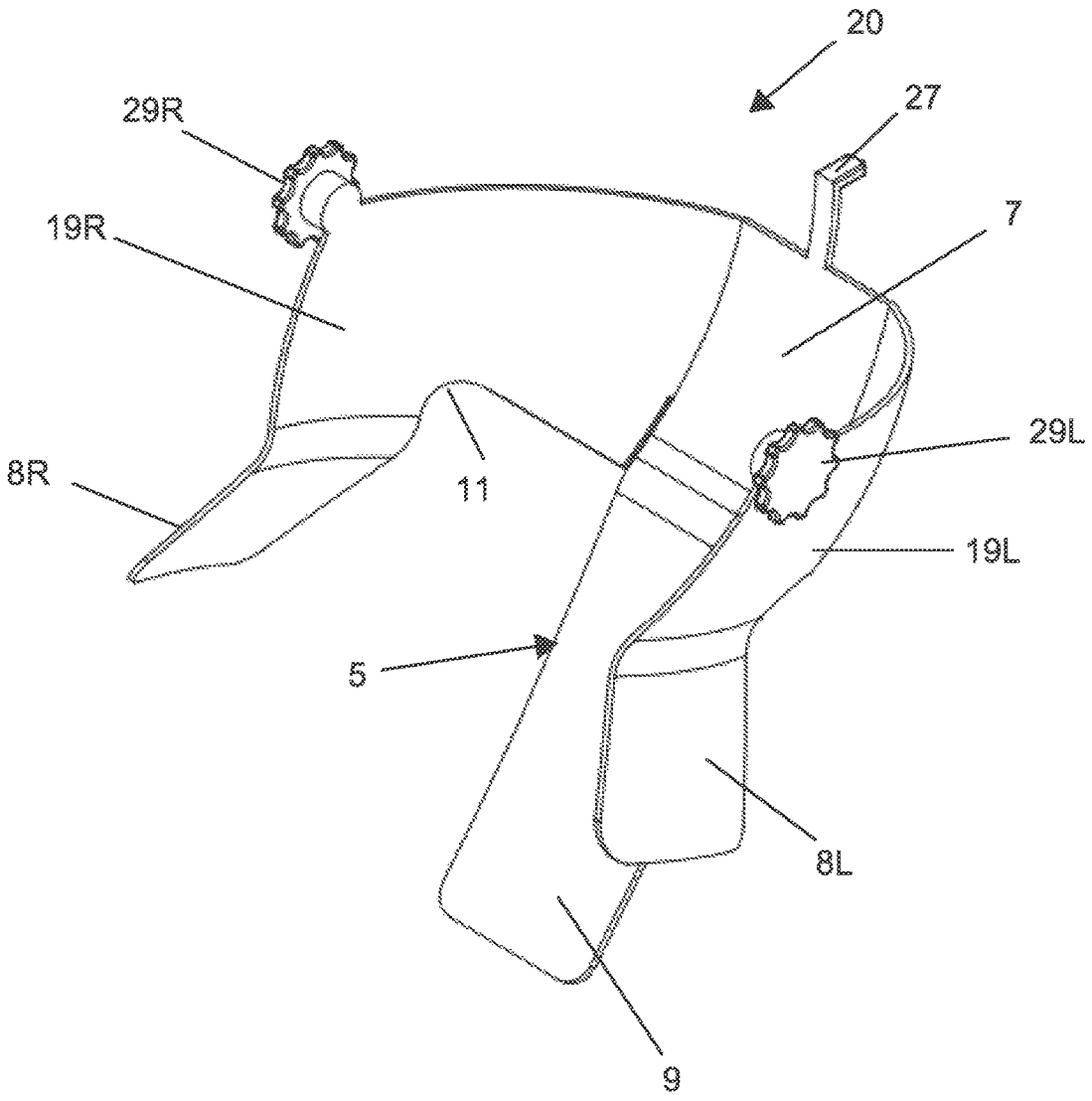
FIG. 6 is a perspective view of a cervical spine support device, according to an embodiment of the present invention.
Figure 7:
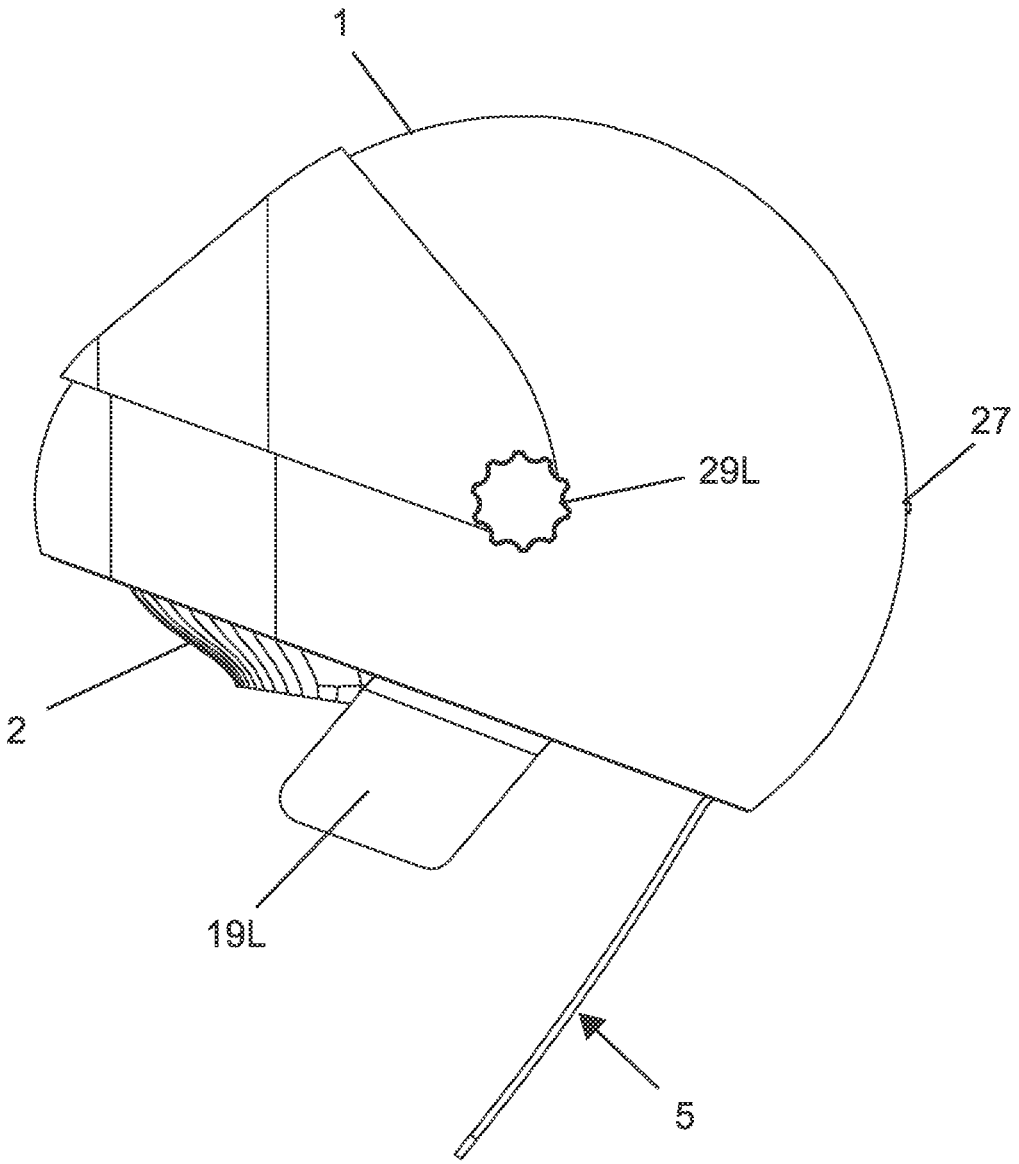
FIG. 7 is a side view of a helmet provided with the cervical spine support device of FIG. 6, when positioned in neck stabilizing engagement with a helmet wearer.

Referring now to FIGS. 6 and 7, device 10 may further comprise a cervical spine support device 20 that is adapted to be in neck stabilizing engagement with the neck of a user 2 who wears helmet 1. Device 10 is a unitary member which is adjustable to fit the neck and face sizes of most people. The mandible engaging sections 15 and the cervical support 20 are adjustable to ensure proper body engagement while exposing the anterior triangle of the helmet wearer's neck. Cervical support 20 may be operated in a similar angled displacement as a helmet's visor as indicated by visor manipulators 29R and 29L, wherein its displacement can be guided by a rail member 27 located at the rear side of helmet 1.

Cervical support 20, which has bilateral symmetry, is made from any suitable flexible and non-irritating material, such as soft foam material, natural and synthetic polymers, and metal wire reinforced materials, which can comfortably conform to the bodily portions when bent and remain engaged for prolonged periods of times without causing decubitis or other types of irritation. An element designated by the letter R will indicate one located on the right side of the subject, and an element designated by the letter L will indicate one located on the left side of the helmet's wearer 2.

An intermediate region 5 of cervical support 20 is defined by an upper, slightly curved portion 7 and a lower elongated portion 9 having a significantly less curvature than upper edge 7.

Figure 8:
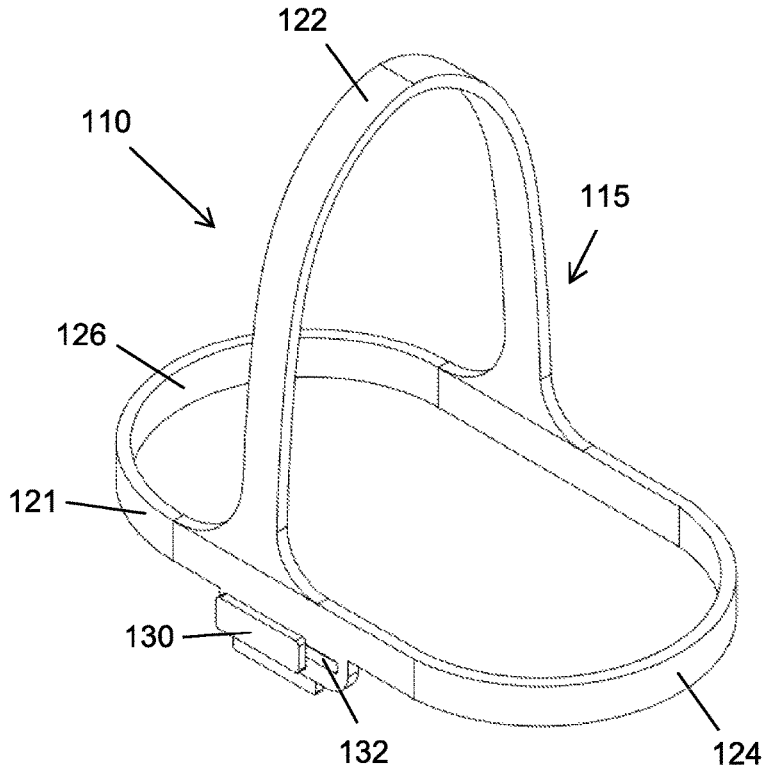
FIG. 8 is a perspective view of an airway opening device for helmets, according to another embodiment of the invention.

Intermediate region 5 is used as a central occipital portion for engaging the occipital bone as shown in FIG. 8 and two sternocleidomastoid (SCM) portions 19 between which occipital portion 5 is interposed for engaging the SCM muscle at the side of the neck. Portion 7 terminates at each side with a concave portion 11 which is defined by an L-shaped laterally extending edge 8 that extends from a corresponding side of intermediate upper portion 7.

In operation with reference to FIG. 7, occipital portion 5 is first positioned to be centered and placed in engagement with the occipital bone of the skull of the helmet's wearer 2. Occipital portion 5 may be positioned when helmet's wearer 2 is in a supine position following for example a trauma situation when excessive movement of the cervical spine is liable to lead to paralysis. The distance between upper portion 7 and lower portion 9 of occipital portion 5 is sufficiently great to ensure that lower edge 9 will contact the upper back. Accordingly, when a sufficient tensile force is applied at the top of occipital portion 5 by the two mandible engaging sections 15 and by the two SCM portions 19, rearward head motion is prevented.

A practitioner standing at the front of the helmet's wearer 2 then pulls on both manipulators 42 of mandible engaging sections 15 simultaneously until a rearward head motion is prevented.

Each carrier 14 of mandible engaging section 15 is manipulated until airway opening member 17 contacts the corresponding mandible angle, to ensure that airway opening member 17 applies a force on the corresponding mandible angle for causing the jaws to open and the airway to remain opened. Although the lips of the wearer 2 appear to be closed, this lip position does not preclude the possibility of the jaws being opened since a jaw opening of even one centimeter is sufficient to ensure an open airway. Forward head movement is thereby prevented since the occipital portion is in engagement with the back of the head. Sideways head movement is also prevented since each SCM portion is in engagement with a corresponding SCM muscle, which runs downwardly along the side of the neck substantially below the ear and functions to rotate or extend the head.

As the structure of the aforementioned cervical support device ensures that the anterior triangle of the neck located between the two SCM muscles remains exposed, as described hereinabove, a medical practitioner is able to monitor various clinical conditions, after the cervical support device has been bodily engaged, which have not been achievable heretofore by prior art helmets wearers in order to provide sufficient head immobility.

For example, an exposed anterior triangle enables a member of an intensive care unit to perform a tracheostomy to invasively open the airway of a neck stabilized subject, or to perform a transfusion via the external jugular vein.

All of these advantages are achievable by a support device that is surprisingly light, easily and quickly manipulated, and of superior neck stabilization, which can be integrated with existing helmets or as a novel type of safety helmets.

Figure 9:
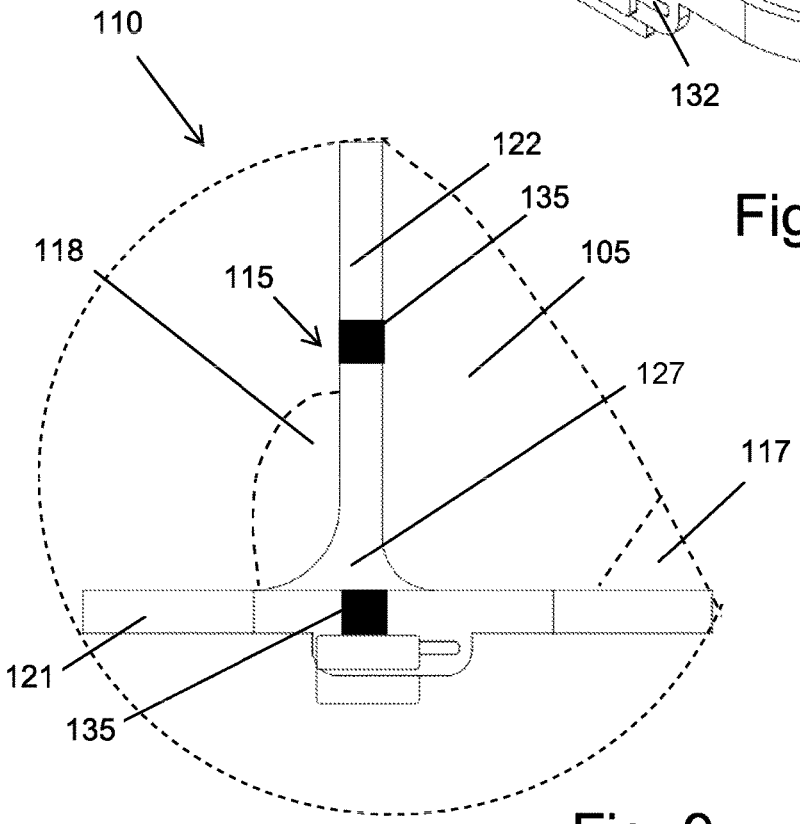
FIG. 9 is a side view of the device of FIG. 8, shown when bodily engaged.

FIGS. 8 and 9 illustrate another embodiment of the invention wherein airway opening device 110 is bodily engaged by means of dedicated headgear 115, on which the mandible engaging sections are mounted and which is detachably connectable to a helmet. Headgear 115 preferably has bilateral symmetry.

The configuration of headgear 115 facilitates easy detachment of the helmet from device 110 while the helmet is on the subject's head and the airway opening member is bodily engaged. The helmet is thus advantageously able to be safely removed from the subject's head without removing the airway opening member and without compromising the open airway. This detachment feature is important in emergency settings when a caregiver needs to have access to the subject's face and/or neck and wishes to maintain an open airway.

As shown in FIG. 8, headgear 115 comprises a first strap 121 that encircles the head, when bodily engaged, to define a plane that approximates a transverse plane. An anterior portion 124 of first strap 121 is adapted to engage the maxilla, and a posterior portion 126 thereof is adapted to engage the occipital bone. The right and left mandible engaging sections 130 are mounted on a corresponding lateral side of first strap 121, and slightly inferiorly separated therefrom. Each schematically illustrated mandible engaging section 130 may be identical to mandible engaging section 15 illustrated in FIG. 1, or may be configured in other ways, as long as it is longitudinally displaceable along groove 132, for example with use of a laterally protruding handle, so that a corresponding airway opening member will apply a force on the corresponding mandible angle and cause the jaws to open, for example by the jaw thrust maneuver.

A second strap 122 substantially perpendicular to first strap 121 is also provided, and extends superiorly from the right side of first strap 121 to the left side thereof. Second strap 122 encircles the skull, when bodily engaged, to define a plane that approximates a frontal plane while engaging the temporal bone and the parietal bone.

Straps 121 and 122 may be made of any rigid and unstretchable material, flexible material, or stretchable material such as plastic, rubber and leather, as long as headgear 115 is suitably secured to the head.

When headgear 115 is mounted on head 105 of a subject, as shown in FIG. 9, first strap is adapted to be engaged on the maxilla without interfering with the nose 117. Also junction 127 of straps 121 and 122 is suitably positioned so as not to interfere with the ear 118.

A schematically illustrated detachment element 135 is shown to be applied to each of straps 121 and 122. It will be appreciated that the number of detachment elements 135, their location on the headwear, and their configuration may be varied in any desired fashion.

The detachment of device 110 from the helmet may be carried out with use of any suitable detachment element 135, whether fasteners such as snaps or hook and loop patches, or by mechanical or electrical actuation. Non-limiting examples for performance of a detachment operation include pulling a lever or pressing a button. Alternatively, the detachment may be done by any other means that allow the quick and easy detachment of the airway opening device from the helmet and the subsequent removal of the helmet.

Airway opening device 110 may also comprise cervical support 20 illustrated in FIG. 6, which may be permanently or detachably connected to the helmet.

In another embodiment, an airway opening device may be configured with an element that is supported on the chin, for example with use of a mesh that covers the chin area, rather than on the maxilla.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A helmet mounted safety device for ensuring an open airway, comprising right and left mandible engaging sections, wherein each of said mandible engaging sections comprises:

i) an adjustable and angled airway opening member having a first element configured to contact a bottom of a corresponding mandible angle of a helmet wearer, and a second element which is angularly spaced from said first element and which is configured to contact the corresponding mandible angle proximate to a junction with a ramus and to assure opening of the airway of the helmet wearer;

ii) an element configured with an anteroposteriorly extending groove;

iii) means connected to said airway opening member and passing through said groove, to urge anteroposterior displacement of said airway opening member; and iv) a connecting element for connection to an area of an interior face of a corresponding inferior region side portion of a helmet that is sufficiently spaced from a corresponding mandible of the helmet wearer to facilitate engagement between said airway opening member and the corresponding mandible angle only following selective anterior displacement of said airway opening member that applies a force to the corresponding mandible angle to cause jaw opening and ensure an open airway.

2. The safety device according to claim 1, further comprising a cervical support that is adapted to be in neck stabilizing engagement with the neck the helmet wearer, wherein the cervical support includes an occipital portion and a two sternocleidomastoid (SCM) portions between which said occipital portion is interposed for engaging the SCM muscle at the side of the neck.

3. The safety device according to claim 2, in which the occipital portion and the two SCM portions are formed as a single unit.

4. The safety device according to claim 1, in which each of the mandible engaging sections comprises a baseplate and a carrier for the airway opening member which is controllably displaceable along the groove which is formed in said baseplate.

5. The safety device according to claim 4, in which the carrier is longitudinally and ratchetedly displaceable along the groove, and is connected to a manipulator by a fastening element passing through the groove.

6. The safety device according to claim 4, in which the airway opening member protrudes medially from the baseplate and a manipulator protrudes distally from the baseplate.

7. The safety device according to claim 4, in which the selective anterior displacement of said airway opening member to ensure an open airway is performable either manually or automatically by applying a device suitable of anteriorly displacing the carrier of the airway opening member.

8. The safety device according to claim 1, in which the airway opening member is activated automatically after detecting an accident event by an integrated impact sensor or by remote operation from a control center.

9. The safety device according to claim 1, wherein the second element of the airway opening member is angularly spaced and extends upwardly from said first element.

10. The safety device according to claim 1, wherein the first and second elements are angularly spaced by an angle ranging from 110 to 160 degrees.

11. The safety device according to claim 2, wherein the cervical support is of bilateral symmetry.

12. The safety device according to claim 1, wherein the connecting element is integrally formed with the interior face of the corresponding inferior region side portion of the helmet.

13. The safety device according to claim 1, wherein the connecting element is a detachment element for facilitating detachment of the safety device from the interior face of the corresponding inferior region side portion of the helmet and removal of the helmet without necessitating movement of the airway opening member.

14. A helmet with an airway opening device for ensuring an open airway for a wearer of the helmet, wherein said helmet is configured with a superior region and with an inferior region which is integrally formed with the superior region and borders an open inferior edge, and the inferior region has two opposed side portions each of which having an interior and an exterior face, said airway opening device comprising right and left mandible engaging sections, wherein each of said mandible engaging sections comprises:

i) an adjustable and angled airway opening member having a first element configured to contact a bottom of a corresponding mandible angle of the helmet wearer, and a second element which is angularly spaced from said first element and which is configured to contact the corresponding mandible angle in the vicinity of a ramus and to assure opening of the airway of the helmet wearer;

ii) an element configured with an anteroposteriorly extending groove; and iii) means connected to said airway opening member and passing through said groove, to urge anteroposterior displacement of said airway opening member, wherein said groove configured element is connected to an area of the interior face of a corresponding inferior region side portion of said helmet to facilitate engagement between said airway opening member and the corresponding mandible angle only following selective anterior displacement of said airway opening member that applies a force to the corresponding mandible angle to cause jaw opening and ensure an open airway.

15. The helmet according to claim 14, further comprising a removable front portion for allowing access to the neck of the wearer.

16. The helmet according to claim 14, further comprising a cervical support that is adapted to be in neck stabilizing engagement with the neck of the wearer, wherein the cervical support includes an occipital portion and two sternocleidomastoid (SCM) portions between which said occipital portion is interposed for engaging the SCM muscle at the side of the neck.

17. The helmet according to claim 14, wherein each of the mandible engaging sections is integrally, permanently or detachably connected to the interior face of the corresponding inferior region side portion of the helmet.

* * * * *